United States Patent [19]

Poppenheimer

[11] Patent Number: 4,539,629

[45] Date of Patent: Sep. 3, 1985

[54] SPA LIGHT

[75] Inventor: Charles B. Poppenheimer, Pasadena, Calif.

[73] Assignee: GTY Industries, Sun Valley, Calif.

[21] Appl. No.: 579,207

[22] Filed: Feb. 10, 1984

[51] Int. Cl.[3] ..... F21V 29/00

[52] U.S. Cl. ..... 362/267; 362/294; 362/311; 362/373

[58] Field of Search ..... 362/267, 294, 183, 293, 362/158, 306, 311, 362, 373, 374, 375

[56] References Cited

U.S. PATENT DOCUMENTS 1,968,072 7/1934 Creighton ..... 362/267

3,513,585 5/1970 Ross ..... 362/216

4,337,508 6/1982 Moffatt ..... 362/294

*Primary Examiner*—Donald P. Walsh

*Attorney, Agent, or Firm*—Lyon & Lyon

[57] ABSTRACT

A spa light having a lens head positionable through the wall of a spa and including a lens facing inwardly in the spa. A two piece housing is assembled to provide a transformer cavity and a lamp cavity, the housing being positionable with the lens head. The transformer cavity is sealed with a transformer therein to reduce the voltage to 12 volts. The lamp cavity is open to receive a lamp, a lamp socket and a reflector. The cavity is arranged to allow convection air flow past the reflector and water flow from the water cavity to avoid excessive accumulation.

7 Claims, 5 Drawing Figures

SPA LIGHT

BACKGROUND OF THE INVENTION

The field of the present invention is lighting devices for underwater use in spas.

Underwater lighting has generally been employed in pools, fountains and the like to enhance the attractiveness, utility and/or safety of the water. Traditional pool lights have typically been located in a niche within the wall of the pool. The niche is larger than the light housing for water cooling of the light. Such water-cooled light systems are often impractical for spas which are generally of polymeric materials, wood, fiberglass or the like. Using such construction, it is impractical or undesirable to form a niche in the sidewall of the spa for receipt of such a lighting system.

In lighting a spa, a relatively bright light is needed which generates a substantial amount of heat required to be directed away from the lamp. Relatively open lighting systems have generally been disfavored because of the water within the spa with people in close proximity. Consequently, lamp overheating is a major design consideration for such lighting.

SUMMARY OF THE INVENTION

The present invention pertains to spa lighting, providing a convection-cooled light system of simple design with safe operation. To this end, a light system of the present invention includes a lens head for mounting to a spa, a housing positionable on the lens head and including provision for a transformer and an air-cooled, low voltage lamp. A lamp cavity receives the low voltage lamp and is arranged for enhanced convection cooling of the lamp and drainage of any water from the lamp cavity.

Thus, an efficient and safe spa light having convection cooling and water drainage from around the lamp is provided by the present invention. Accordingly, it is an object of the present invention to provide an improved lighting system for spas.

DETAILED DESCRIPTION OF THE PREFERRED EMBODIMENT

Figure 1:
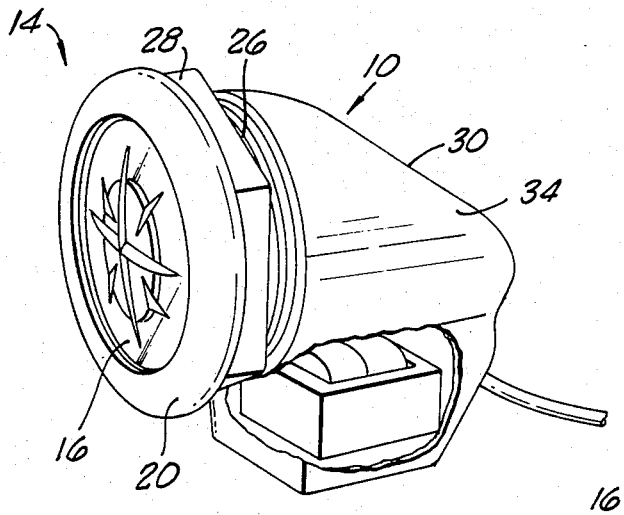
FIG. 1 is an oblique view of a light of the present invention.
Figure 2:
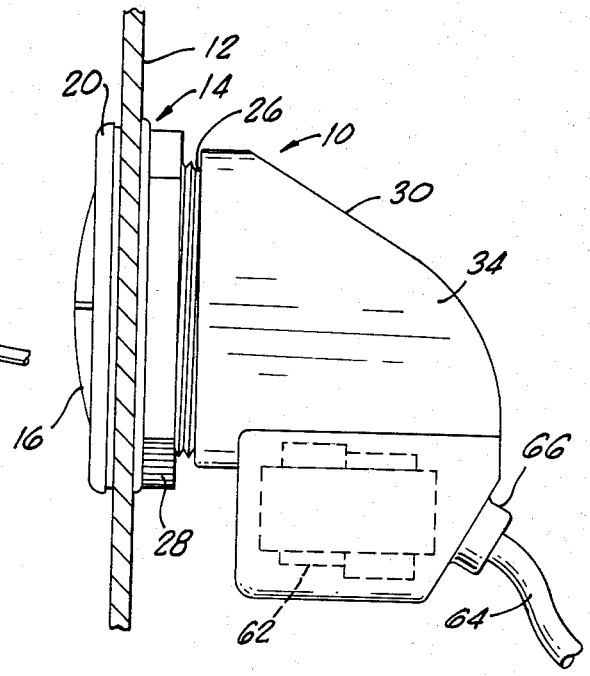
FIG. 2 is a side view of a light of the present invention illustrating the wall of a spa in cross-section.
Figure 3:
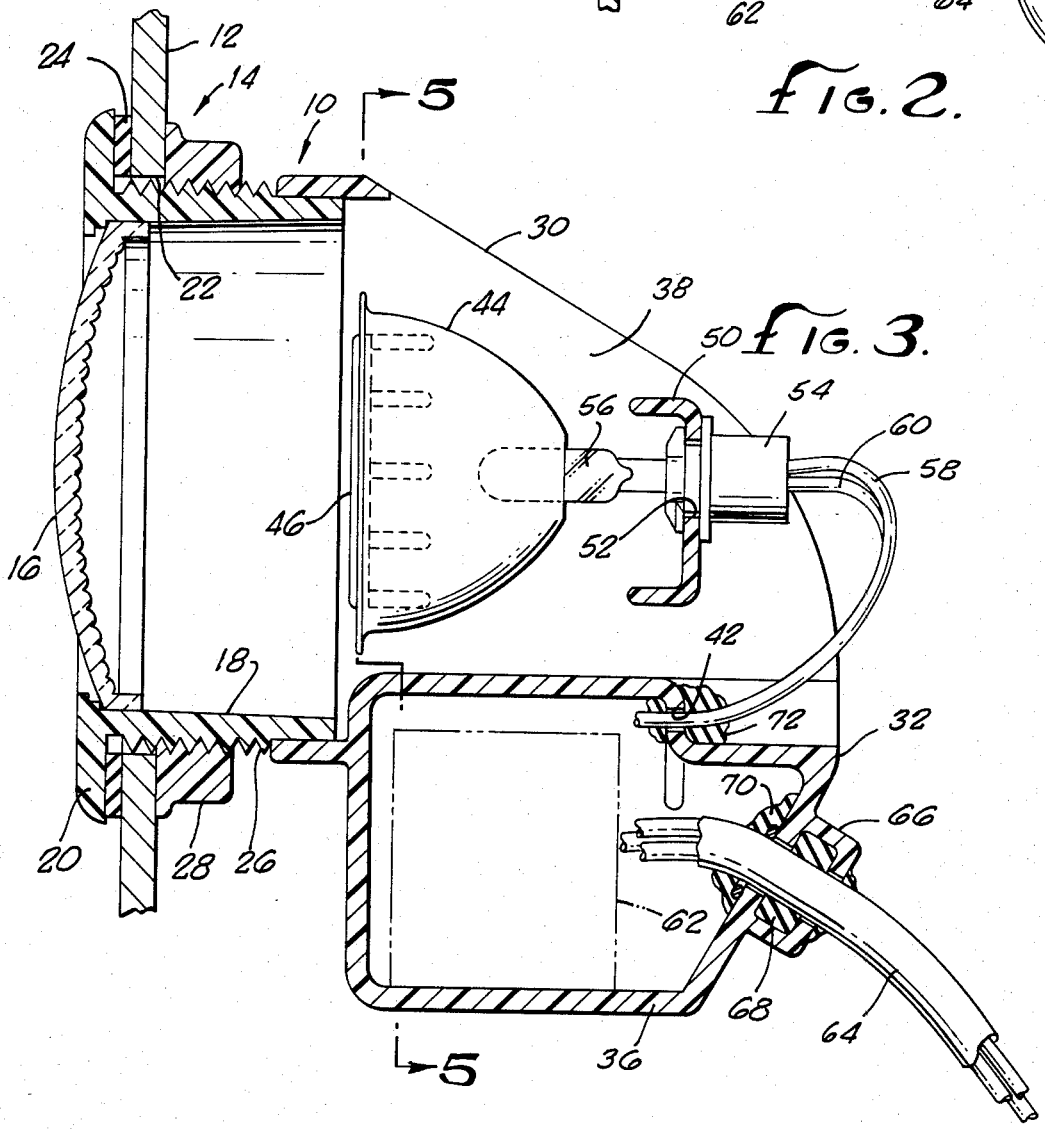
FIG. 3 is a cross-sectional side elevation taken through the symmetrical center line of the light.

Turning in detail to the drawings, a spa light system is illustrated which is positionable through the wall of a spa. The light, generally designated 10, is shown positioned on the wall 12 of a spa in FIGS. 2 and 3. The interior of the spa is to the left as illustrated in both Figures. Naturally, the wall thickness may vary depending on the material and design of manufacture.

A lens head, generally designated 14, is designed for mounting to the wall 12 of the spa. The lens head 14 includes a lens 16 which faces inwardly in the spa. The lens 16 may be of the fresnel type for effective light distribution. The lens 16 is permanently fixed in a cylindrical body 18 in a manner which preferably seals the joint between the lens 16 and the body 18 to prevent leakage of the spa. Also provided on the lens head 14 is a means for mounting the lens head to the spa. At a first end of the body 18 adjacent the lens 16 is a radially extending flange 20. The radially extending flange 20 forms a smooth light fixture profile within the spa about the lens 16. Additionally, the flange 20 retains the lens head 14 in position through a hole 22 in the wall 12 of the spa. A gasket 24 seals the joint between the flange 20 and the wall 12. To snugly retain the lens head 14 on the wall 12, the body 18 includes an outer threaded surface 26 with which is associated a nut 28. The nut 28 is threaded onto the surface 26 into abutment against the wall 12 to compress the seal 24.

Figure 4:
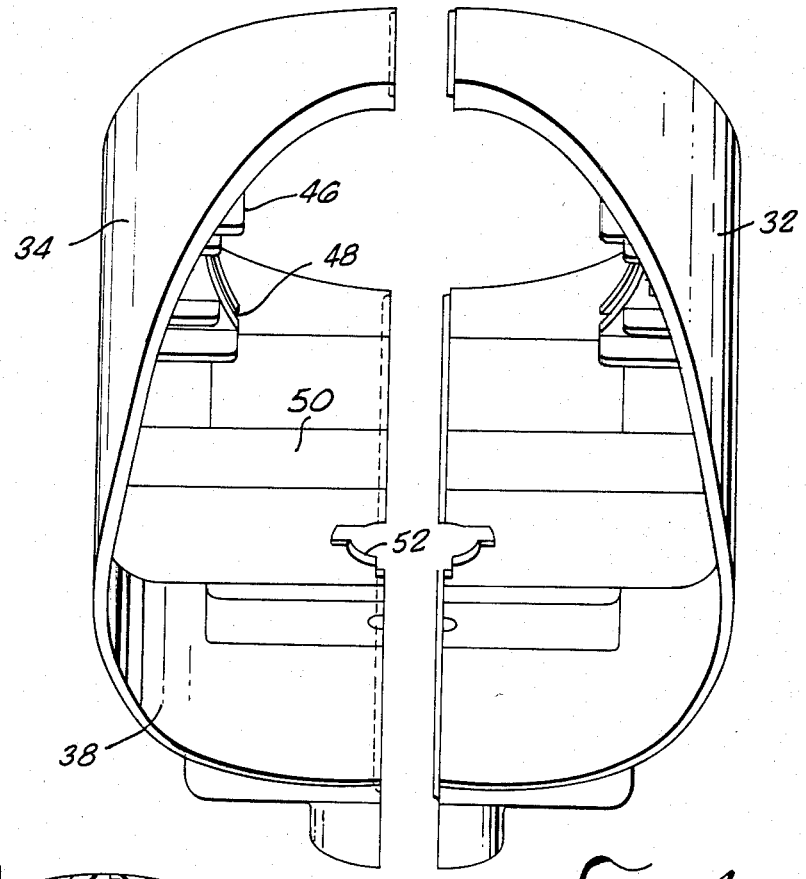
FIG. 4 is a top view of the right and left-hand sections of the housing.
Figure 5:
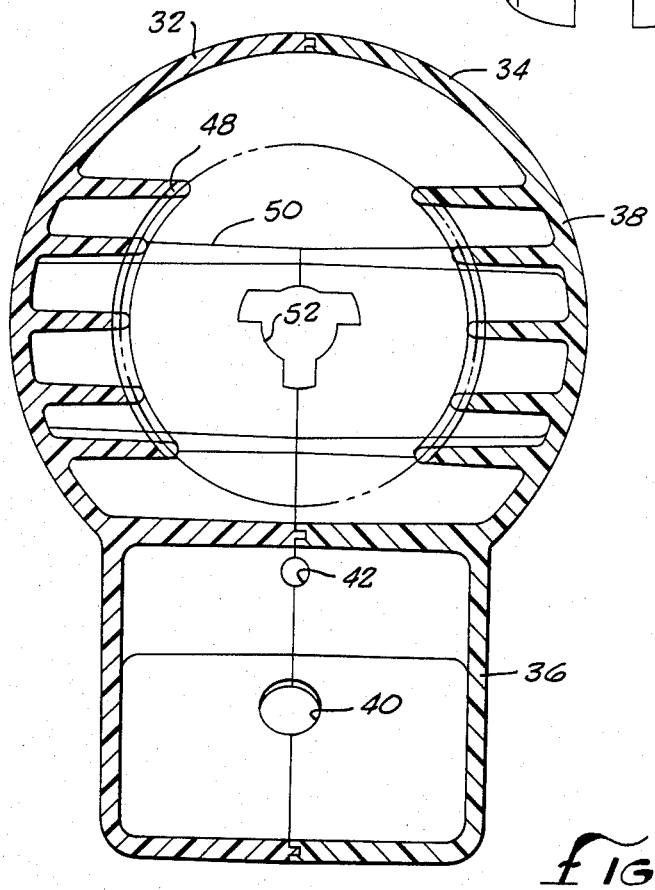
FIG. 5 is a cross-sectional elevation taken along line 5—5 of FIG. 3.

Associated with the lens head 14 is a housing 30. The housing 30 is formed by joining about a symmetrical centered line a right-hand section 32 and a left-hand section 34. This assembly arrangement may best be illustrated in FIGS. 4 and 5. The housing 30 thus constructed may be divided into two portions, a transformer cavity 36 and a open, lamp cavity 38. The transformer cavity 36 is fully enclosed with the exception of access holes 40 and 42. The open, lamp cavity 38 defined by the housing 30 is generally cylindrical with a substantial segment missing from that cylindrical shape. In this way, a cylindrical portion surrounds the forward part of the lamp and meets with the body 18 of the lens head 14. Laterally and outwardly away from the spa from that juncture of the housing 30 and the lens head 14, the cavity 38 is exposed or open upwardly and outwardly. This arrangement promotes convection flow of cooling air around the heated portion of the lamp. Additionally, the rearward opening of the cavity 38 allows drainage of any water which might otherwise accumulate in sufficient amount to cause electrical problems. This is so regardless of the angular orientation of the housing 30 relative to the lens head 14.

Contained within the lamp cavity 38 is a reflector 44. The reflector 44 faces toward the lens 16 for maximum light transmission through the lens 16. Retaining fingers 46 extend outwardly from each section 32 and 34 of the housing 30 to locate and retain the reflector 44. A groove 48 retains the lip of the reflector 44.

Extending across the lamp cavity is a bracket 50. The bracket 50 extends from each section 32 and 34 to meet in the middle of the lamp cavity 38. A hole 52 is formed centrally in the bracket to receive a lamp socket 54. Associated with the lamp socket 54 and extending forwardly into the reflector 44 is a lamp 56. The lamp 56 is preferably a 12-volt quartz halogen lamp. Naturally, the lamp 56 can be replaced by removal of the socket 54 as may be needed.

To deliver power to the lamp 56, the socket 54 is associated with leads 58 and 60. The leads 58 and 60 extend through the access hole 42 into the transformer cavity 36. A transformer 62 is positioned within the transformer cavity 36 to receive the leads 58 and 60. Also coupled with the transformer is three wire cord 64 of underwater capacity. A seal and stress relief for the cord 64 are provided by an extended socket 66, sealing material 68 and a hog ring 70. The transformer cavity 36 may be filled with sealant where appropriate. Resilient sealing material 72 is also positioned about the leads 58 and 60 to ensure watertight seal of the transformer cavity 36.

In assembling the light 10, the transformer 62 and the reflector 44 are appropriately positioned in one of the two sections 32 and 34. The other section is then brought into position, locking the reflector 44 and the transformer 62 in place. The sections are then bonded or welded together. Naturally, the wires to the transformer 62 must also be appropriately positioned and coupled with the transformer 62 prior to closure of the housing. The positioning of the housing 30 on the lens head 14 is accomplished at the spa once the lens head 14 has been positioned on the spa. The housing 30 may be bonded to the lens head 14 or brought into interlocking engagement through the use of conventional bayonet couplings or the like.

Accordingly, a simply constructed, efficient and safe spa light is disclosed. While embodiments and applications of this invention have been shown and described, it would be apparent to those skilled in the art that many more modifications are possible without departing from the inventive concepts herein. The invention, therefore, is not to be restricted except by the spirit of the appended claims.

I claim:

1. A light for a spa, comprising a lens head having a lens and means for mounting said lens head to the spa with said lens facing inwardly in said spa;

a housing positionable on said lens head to extend outwardly from the spa and having a transformer cavity and an open lamp cavity;

a reflector positioned in said open lamp cavity facing said lens;

a lamp socket for receiving a lamp and said reflector;

said lamp cavity being open upwardly and outwardly from said spa to allow convection air flow past said lamp and water flow from said open lamp cavity with said housing positioned on said lens head.

2. The light of claim 1 further comprising a transformer in said transformer cavity, said transformer cavity being fully sealed.

3. The light of claim 1 wherein said housing further has a bracket extending across said lamp cavity to receive said lamp socket.

4. The light of claim 1 wherein said mounting means includes a radially extending flange, a threaded surface about said lens head and a nut on said threaded surface, said flange and said nut being positionable on opposite sides of a wall of the spa with said threaded surface extending therethrough.

5. The light of claim 1 wherein said housing is constructed of a right-hand section and a left-hand section, said sections being joined at a symmetrical center line.

6. The light of claim 2 wherein said transformer has an output of approximately twelve volts.

7. The light of claim 1 wherein said open lamp cavity is generally cylindrical with a substantial segment missing from the upper portion.

* * * * *